US007953346B2

(12) United States Patent
Ahn et al.

(10) Patent No.: US 7,953,346 B2
(45) Date of Patent: May 31, 2011

(54) DEVELOPING CARTRIDGE, IMAGE FORMING APPARATUS, AND METHOD OF MOUNTING/SEPARATING DEVELOPING CARTRIDGE ON/FROM IMAGE FORMING APPARATUS

(75) Inventors: Dong-cheol Ahn, Yongin-si (KR); Young-min Kim, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 694 days.

(21) Appl. No.: 11/933,578

(22) Filed: Nov. 1, 2007

(65) Prior Publication Data

US 2008/0226338 A1 Sep. 18, 2008

(30) Foreign Application Priority Data

Mar. 15, 2007 (KR) ..... 10-2007-0025434

(51) Int. Cl.
*G03G 21/16* (2006.01)

(52) U.S. Cl. ..... 399/111; 399/113; 399/125

(58) Field of Classification Search ..... 399/111, 399/113, 125

See application file for complete search history.

(56) References Cited

U.S. PATENT DOCUMENTS

| | | | | |
|---|---|---|---|---|
| 5,787,323 | A | 7/1998 | Nomura et al. | |
| 2008/0226337 | A1 * | 9/2008 | Han et al. | 399/111 |

FOREIGN PATENT DOCUMENTS

| | | |
|---|---|---|
| EP | 0770936 | 5/1997 |
| JP | 8006471 | 1/1996 |
| JP | 8227258 | 9/1996 |
| JP | 2006154616 | 6/2006 |

OTHER PUBLICATIONS

European Search Report dated Jul. 7, 2008 in EP07122347.3.
European Examination Report issued Jul. 30, 2009 in EP Application No. 07122347.3.

* cited by examiner

*Primary Examiner* — Ryan D Walsh
(74) *Attorney, Agent, or Firm* — Stanzione & Kim, LLP

(57) ABSTRACT

An image forming apparatus having a developing cartridge includes a lower main body, and a developing cartridge installed in the lower main body and including a photosensitive medium. An upper main body may be separably installed on an upper side of the lower main body and includes an upper pressing member to press the developing cartridge downward. A lower pressing member, installed in the lower main body, is positioned to press the developing cartridge upward. In the case where a rotation axis of the photosensitive medium of the developing cartridge is set as a rotation center, a moment of force is applied to the developing cartridge by the upper pressing member and an opposing moment of force being is applied to the developing cartridge by the lower pressing member in the opposite direction.

20 Claims, 5 Drawing Sheets

DEVELOPING CARTRIDGE, IMAGE FORMING APPARATUS, AND METHOD OF MOUNTING/SEPARATING DEVELOPING CARTRIDGE ON/FROM IMAGE FORMING APPARATUS

CROSS-REFERENCE TO RELATED APPLICATIONS

This application claims priority under 35 U.S.C. §119(a) from Korean Patent Application No. 2007-25434, filed Mar. 15, 2007, in the Korean Intellectual Property Office, the entire disclosure of which is hereby incorporated in its entirety by reference.

BACKGROUND OF THE INVENTION

1. Field of the Invention

The present general inventive concept relates to an image forming apparatus and a method of mounting/separating a developing cartridge for use in the image forming apparatus on/from the image forming apparatus.

2. Description of the Related Art

Generally, an image forming apparatus creates a print by forming an electrostatic latent image on a photosensitive medium, forming a toner image by supplying toner to the formed electrostatic latent image, and then transferring the toner image to a print medium such as printing paper.

In such an image forming apparatus, the photosensitive medium and a developing part that supplies the toner to the photosensitive medium are printing consumables which should be replaced after a predetermined number of copies are printed. In order to facilitate the replacement of the photosensitive medium and the developing part, it is common to make the photosensitive medium and the developing part as a single unit. Hereinafter, a unit in which the photosensitive medium and the developing part are combined will be referred to as a developing cartridge.

When the developing cartridge is installed in a main body of the image forming apparatus, the photosensitive medium of the developing cartridge comes into contact with a transfer roller. In operation, as a print medium passes between the photosensitive medium and the transfer roller, the toner image formed on the photosensitive medium is transferred to the print medium.

In order to properly transfer the toner image of the photosensitive medium to the print medium, the photosensitive medium should maintain its position stably with respect to the transfer roller. Particularly, in order to perform a high picture quality printing using an image forming apparatus having a user-replaceable developing cartridge, the photosensitive medium of a developing cartridge, mounted to the main body of the image forming apparatus to replace a used developing cartridge, should stably keep its predetermined position with respect to the transfer roller of the main body of the image forming apparatus.

SUMMARY OF THE INVENTION

The present general inventive concept provides an image forming apparatus provided with a developing cartridge and a method of mounting/separating a developing cartridge on/from an image forming apparatus, which can make a photosensitive medium of a developing cartridge stably keep its position with respect to a transfer roller after replacement of the developing cartridge.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus, according to embodiments of the present general inventive concept, which includes a lower main body of the image forming apparatus, a developing cartridge installed in the lower main body, and including a photosensitive medium, an upper main body of the image forming apparatus separably installed on an upper side of the lower main body, and including an upper pressing member to press the developing cartridge downward, and a lower pressing member, installed in the lower main body, to press the developing cartridge upward, wherein in the case where a rotation axis of the photosensitive medium of the developing cartridge is set as a rotation center, a moment of force being applied to the developing cartridge by the upper pressing member and a moment of force being applied to the developing cartridge by the lower pressing member act in opposite directions to each other.

The developing cartridge may be rotatably installed with respect to the lower main body.

The developing cartridge may include base projections installed on both side surfaces thereof, the lower main body may include support grooves to support the base projections, and the developing cartridge may be rotated around the base projections by the moment of force produced by the lower pressing member or the upper pressing member.

The lower main body may further include a lower stopper to limit rotation of the developing cartridge.

The upper pressing member may include at least one of a developing cartridge pressing member and a memory connection member.

The lower pressing member may include at least one of a transfer roller and a driving gear.

When the photosensitive medium is rotated, the moments of force being applied to the developing cartridge by the upper pressing member and the lower pressing member may be kept in equilibrium.

When the photosensitive medium starts its rotation, the developing cartridge may be minutely rotated in one direction with respect to the lower main body.

When the upper main body is opened, the developing cartridge may be minutely rotated in the same direction as that when the photosensitive medium is rotated.

When the upper main body is closed to cover the upper surface of the lower main body, the developing cartridge may be minutely rotated in an opposite direction to that when the upper main body is opened.

The foregoing and/or other aspects and utilities of the present general inventive concept may also be achieved by providing a method of separating a developing cartridge from an image forming apparatus, which includes when an upper main body of the image forming apparatus is opened, minutely rotating the developing cartridge installed in a lower main body of the image forming apparatus in one direction with respect to the lower main body, and removing the developing cartridge from the lower main body.

The foregoing and/or other aspects and utilities of the present general inventive concept may also be achieved by providing a method of separating a developing cartridge from an image forming apparatus, which includes when a driving gear that rotates a photosensitive medium of the developing cartridge installed in a lower main body of the image forming apparatus is stopped, minutely rotating the developing cartridge in one direction with respect to the lower main body, when an upper main body of the image forming apparatus is opened, minutely rotating the developing cartridge in an opposite direction to the previous rotation direction with respect to the lower main body, and removing the developing cartridge from the lower main body.

The foregoing and/or other aspects and utilities of the present general inventive concept may also be achieved by providing a method of mounting a developing cartridge on an image forming apparatus, which includes mounting the developing cartridge on a lower main body of the image forming apparatus, and when an upper main body of the image forming apparatus is closed to cover the upper surface of the lower main body, minutely rotating the developing cartridge in one direction with respect to the lower main body.

The method of mounting a developing cartridge on an image forming apparatus according to embodiments of the present general inventive concept may further include when a driving gear for rotating a photosensitive medium of the developing cartridge is rotated, minutely rotating the developing cartridge in an opposite direction to the previous rotation direction with respect to the lower main body.

The foregoing and/or other aspects and utilities of the present general inventive concept may also be achieved by providing a developing cartridge mounted on an image forming apparatus, which includes a case having a pressed part formed on an upper surface of the case and pressed by the image forming apparatus when the developing cartridge is mounted on the image forming apparatus, base projections formed on both side surfaces of the case, a photosensitive medium rotatably installed in the case and having a part exposed to a lower surface of the case, and a photosensitive medium gear installed on the same axis as the photosensitive medium, wherein when the developing cartridge is installed on the image forming apparatus, moments of force being applied to the photosensitive medium and the photosensitive medium gear and a moment of force being applied to the pressed part, centering around the base projections, act in opposite directions to each other.

The case may include a plurality of pressed parts, and the plurality of pressed parts may include a pressure support part pressed by a developing cartridge pressing member installed in the image forming apparatus, and a terminal part of a developing cartridge memory that is in contact with a memory connection member installed in the image forming apparatus.

The foregoing and/or other aspects and utilities of the present general inventive concept may also be achieved by providing a developing cartridge mounted on an image forming apparatus, which includes a case having two pressure support parts and a terminal part formed on an upper surface of the case, a photosensitive medium rotatably installed in the case and having a part exposed to a lower surface of the case, and a photosensitive medium gear installed on the same axis as the photosensitive medium, wherein when the developing cartridge is installed on the image forming apparatus, force acting on upper sides of the two pressure support parts and the terminal part urges the case to be rotated in one direction around a rotating axis of the photosensitive medium, and force being applied to a lower surface of the photosensitive medium by a transfer roller of the image forming apparatus urges the case to be rotated in an opposite direction.

The foregoing and/or other aspects and utilities of the present general inventive concept may also be achieved by providing a photosensitive medium for a developing cartridge that is separably installed in an image forming apparatus, wherein the developing cartridge includes a case having pressure support parts formed on an upper surface of the case and pressed by a developing cartridge pressing member installed in the image forming apparatus when the developing cartridge is installed in the image forming apparatus, and a terminal part of a developing cartridge memory formed on the upper surface of the case and being in contact with a memory connection member installed in the image forming apparatus, and base projections formed on both side surfaces of the case, and the photosensitive medium includes a photosensitive medium gear rotatably installed in the case, installed on the same axis as the photosensitive medium, and meshed with a driving gear of the image forming apparatus, wherein when the developing cartridge is installed on the image forming apparatus and the driving gear of the image forming apparatus starts its rotation, moments of force acting on the pressure support parts and the terminal part of the developing cartridge memory and a moment of force acting on the photosensitive medium gear around the base projections act in opposite directions to each other.

The foregoing and/or other aspects and utilities of the present general inventive concept may also be achieved by providing an image forming apparatus including a housing, a developing cartridge including a photosensitive medium, the developing cartridge being rotatably mounted within the housing, a driving mechanism mechanically connected to the developing cartridge to move the photosensitive medium and to rotate the developing cartridge.

The foregoing and/or other aspects and utilities of the present general inventive concept may also be achieved by providing a method for forming an image, including moving a cartridge mounted within a housing of an image forming apparatus from a first position to a second position, transferring an image from a photosensitive medium within the cartridge to a printing medium external to the cartridge while the cartridge is in the second position.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
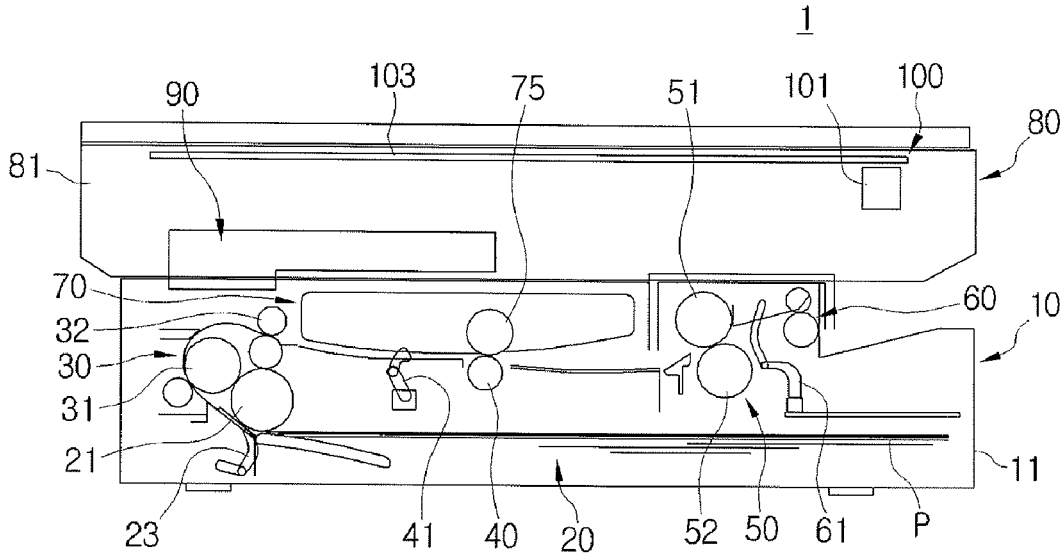
FIG. 1 is a sectional view of an image forming apparatus according to an exemplary embodiment.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
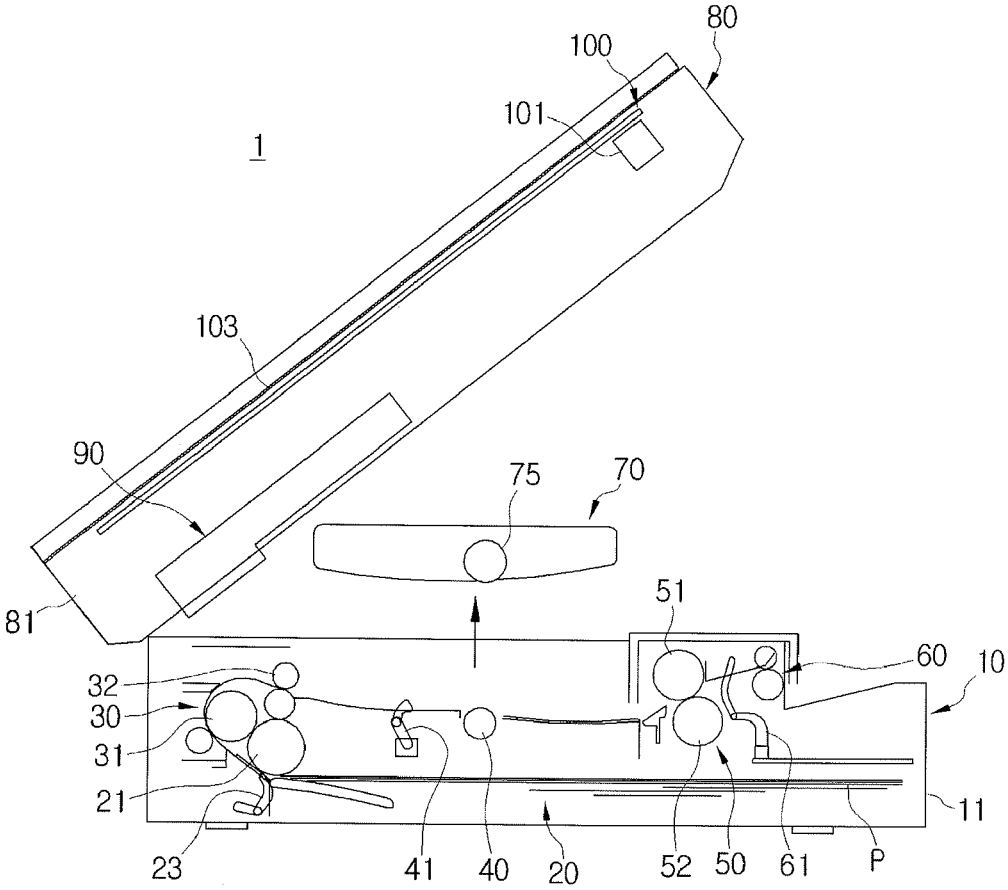
FIG. 2 is a sectional view of the image forming apparatus of FIG. 1, explaining a state that a developing cartridge is separated from the image forming apparatus.

FIG. 1 is a sectional view of an image forming apparatus according to an exemplary embodiment, and FIG. 2 is a sectional view of the image forming apparatus of FIG. 1, illustrating a state where a developing cartridge is separated from the image forming apparatus.

Referring to FIGS. 1 and 2, the image forming apparatus 1 according to an exemplary embodiment comprises a lower main body 10, an upper main body 80, and a developing cartridge 70.

The lower main body 10 comprises a lower frame 11, a print medium feed unit 20, a conveyor roller unit 30, a transfer roller 40, a fuser unit 50, and a delivery unit 60.

The lower frame 11 forms an external appearance of the lower main body 10, and protectively supports the print medium feed unit 20, the conveyor roller unit 30, the transfer roller 40, the fuser unit 50, and the delivery unit 60.

The print medium feed unit 20 is installed in the lower frame 11, and carries print medium P, i.e., printing papers, therein. At the front end of the print medium feed unit 20, a pickup roller 21 to pick up and feed the print medium P sheet by sheet is mounted. Also, a print medium detection sensor 23 to detect whether the print medium P is carried is installed in the print medium feed unit 20.

The conveyor roller unit 30 here comprises conveyor rollers pairs 31 and 32, and conveys the print medium P picked up from the print medium feed unit 20 to the transfer roller 40. Each of the conveyor rollers pairs 31 and 32 may be a drive conveyor roller and a backup conveyor roller which are rotated and in contact with each other. In the exemplary embodiment, the conveyor roller unit 30 comprises two pairs of conveyor rollers 31 and 32 but this number may vary as desired.

The transfer roller 40 transfers a toner image formed on a photosensitive medium 75 to the print medium P and has elasticity. Although not illustrated, the transfer roller 40 may be supported upward by elastic members.

On the lower frame 11 near both ends of the transfer roller 40, support grooves 13 (see FIG. 5) support base projections 73 of the developing cartridge 70 (to be described later) are formed. When the base projections 73 of the developing cartridge 70 are located in the support grooves 13, the photosensitive medium 75 of the developing cartridge 70 may contact the transfer roller 40. In this case, the support grooves 13 of the lower main body 10 are formed so as to allow the developing cartridge 70 to be rotated by a specified angle around the base projections 73. Accordingly, the developing cartridge 70 can be rotated with respect to the lower main body 10. In order to limit the rotation angle of the developing cartridge 70, the lower main body 10 comprises a lower stopper 19 that limits the counterclockwise rotation of the developing cartridge 70. The lower stopper 19 is installed in a proper position on the lower frame 11 so as to limit the counterclockwise rotation of the developing cartridge 70.

On one side of the transfer roller 40, a driving gear 15 which transmits power to the photosensitive medium 75 of the developing cartridge 70 is installed. The driving gear 15 is rotated by a motor (not illustrated) installed in the lower main body 10. The power transmission structure to transmit power to the photosensitive medium 75 through the driving gear 15 is rotated by a motor. The power transmission structure and motor may be any which are suitable including those well known in the art.

When the driving gear 15 is rotated, the photosensitive medium 75 is urged to rotate by the rotating force of the driving gear 15. If the driving gear 15 rotates clockwise with respect to the illustration of FIG. 6, the photosensitive medium 75 is urged to rotate counterclockwise. Accordingly, the developing cartridge 70 is urged to rotate upward (i.e., counterclockwise) around the base projections 73.

In the exemplary embodiment, the developing cartridge 70 is pressed upward by the transfer roller 40 installed in the lower main body 10 of the image forming apparatus 1. That is, the transfer roller 40 serves as a lower pressing member that presses the developing cartridge 70 upward.

Figure 6:
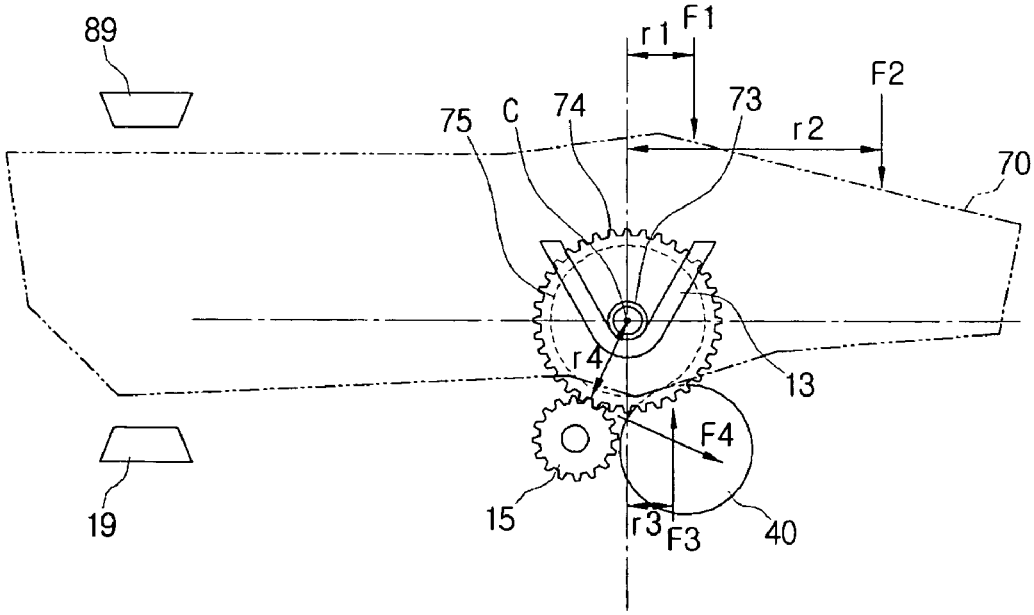
FIG. 6 is a conceptual view explaining moments of force acting on the developing cartridge when a driving gear is rotated in an image forming apparatus according to an exemplary embodiment.

In addition, the driving gear 15, as illustrated in FIG. 6, urges the developing cartridge 70 to be rotated counterclockwise around the base projections 73. This means that the developing cartridge 70 is pressed upward by the driving gear 15. Accordingly, the driving gear 15 also serves as a lower pressing member that presses the developing cartridge 70 upward.

Between the transfer roller 40 and the conveyor roller unit 30, a feed sensor 41 is installed to sense the print medium that passes between the transfer roller 40 and the photosensitive medium 75.

The fuser unit 50 fuses the transferred toner image on the print medium by applying heat and pressure to the printing medium, and comprises a pressing roller 52 and a heating roller 51.

The delivery unit 60 delivers the print medium after being fixed by the fuser unit 50 to an outside of the image forming apparatus 1, and includes a delivery roller and a backup delivery roller.

Between the delivery unit 60 and the fuser unit 50, a delivery sensor 61 to detect the print medium being delivered through the fuser unit 50 is installed.

The upper main body 80 is installed to cover the upper surface of the lower main body 10. In the exemplary embodiment described above, the upper main body 80 is hinge-engaged with the lower main body 10, and comprises an upper frame 81, a scanning unit 100, and an exposure unit 90.

Figure 3:
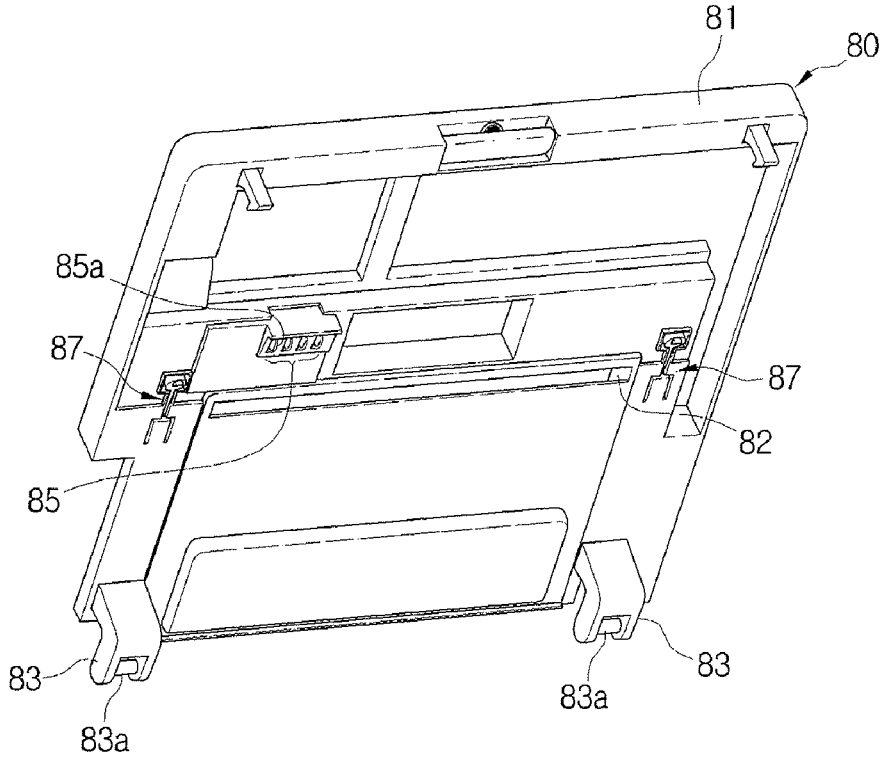
FIG. 3 is a perspective view of an upper main body of the image forming apparatus of FIG. 1.

The upper frame 81 enables the upper main body 80 to cover the upper surface of the lower main body 10, and supports the scanning unit 100 and the exposure unit 90. Referring to FIG. 3, on one side of the upper frame 81, two upper hinge parts 83 are installed, and hinge shafts **83*a* are formed on the upper hinge parts 83, respectively. Although not illustrated, two lower hinge parts, which correspond to the two upper hinge parts 83, are formed on the lower frame 11 of the lower main body 10, and hinge holes, into which the hinge shafts 83*a* are inserted, are formed on the two lower hinge parts. Accordingly, the upper main body 80 can be rotated by a predetermined angle around the hinge shafts 83*a* with respect to the lower main body 10**.

The scanning unit 100 operates to scan a document, and comprises a scanning module 101, which linearly moves to scan the document, and a document stand 103 on which the document is placed. The scanning module 101 and the document stand 103 may be the same as or similar to those of a flat scanner used in a general multifunctional device.

The exposure unit 90 forms an electrostatic latent image on the photosensitive medium by irradiating laser beams based on the received print data. The exposure unit 90 may be the same as or similar to an exposure unit used in a general image forming apparatus. On a lower surface of the upper frame 81, an exposure hole 82 (referring to FIG. 3), through which the laser beams irradiated from the exposure unit 90 passes, is formed.

The upper main body 80 comprises a developing cartridge pressing member 87 to press the developing cartridge 70 when the upper main body 80 is closed to cover the upper surface of the lower main body 10. The developing cartridge pressing member 87 is installed on the lower surface of the upper main body 80, and presses the developing cartridge 70 downward, so that the photosensitive medium 75 of the developing cartridge 70 comes into contact with the transfer roller 40. In the exemplary embodiment, referring to FIG. 3, two developing cartridge pressing members 87 are installed on the lower surface of the upper main body 80, spaced apart by a predetermined interval.

Figure 4:
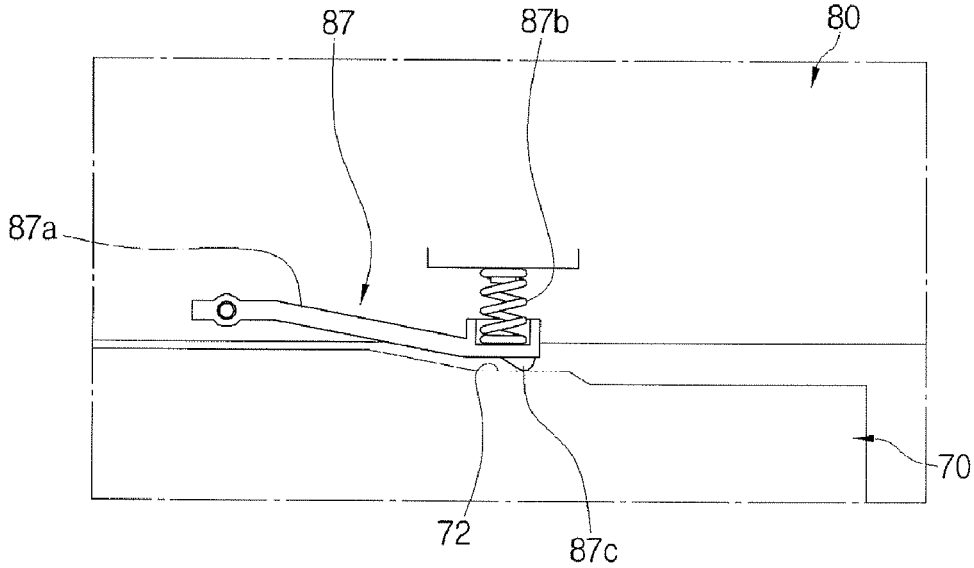
FIG. 4 is a partially enlarged sectional view of a developing cartridge that is pressed by a developing cartridge pressing member of the image forming apparatus of FIG. 1.

Referring to FIG. 4, the developing cartridge pressing member 87 comprises a pressing lever 87*a* and a pressing spring 87*b*. One end of the pressing lever 87*a* is rotatably installed on the upper main body 80, and the other end thereof is projected from the lower surface of the upper main body 80 and is elastically supported by the pressing spring 87*b*. On a lower surface of the other end of the pressing lever 87*a*, a projection part 87*c* may be formed so as to stably press the developing cartridge 70. Accordingly, if the upper main body 80 is closed to cover the upper surface of the lower main body 10, the projection 87*c* formed on the other end of the pressing lever 87*a* of the developing cartridge pressing member 87 presses the pressure support part 72 of the case 71 of the developing cartridge 70. As with all elements of this exemplary embodiment, the structure of the developing cartridge pressing member 87 as described above is only exemplary. Any structure of the developing cartridge pressing member 87 can be used which allows the developing cartridge pressing member 87 to press the developing cartridge 70 when the upper main body 80 is closed with the lower main body 10.

In addition, the upper main body 80 comprises a memory connection member 85 installed on its lower surface. The memory connection member 85 connects a developing cartridge memory (not illustrated) installed in the developing cartridge 70 to a control part (not illustrated) of the image forming apparatus 1, so that the control part can read data from the developing cartridge memory. Accordingly, when the upper main body 80 is closed to cover the upper surface of the lower main body 10, the memory connection member 85 comes into contact with a terminal part 77 of the developing cartridge memory. The terminal part 77 of the developing cartridge memory comprises four terminals 77*a* which is composed of three signal terminals and one power terminal, and thus the memory connection member 85 also has four connection terminals 85*a* corresponding to the terminals 77*a* of the terminal part 77 of the developing cartridge memory. The respective connection terminal 85*a* is in the form of a semicircle, and is made of a metallic material that can transmit electric signals. In addition, the memory connection member 85 has elasticity, and thus when the upper main body 80 is closed to cover the upper surface of the lower main body 10, the memory connection member 85 becomes in contact with the terminal part 77 of the developing cartridge memory. Accordingly, when the upper main body 80 is closed to cover the upper surface of the lower main body 10, the memory connection member 85 presses the terminal part 77 of the developing cartridge 70 downward.

In the image forming apparatus 1 according to an exemplary embodiment, when the upper main body 80 is closed to cover the upper surface of the lower main body 10, the developing cartridge pressing member 87 and the memory connection member 85 located on the upper main body 80 press the developing cartridge 70 downward. That is, the developing cartridge pressing member 87 and the memory connection member 85 serve as an upper pressing member that presses the developing cartridge 70 downward.

As described above, it is exemplified that the scanning unit 100 is installed on the upper main body 80. However, the upper main body 80 may exclude the scanning unit 100. In this case, the upper main body 80 may only serve as an upper cover with respect to the lower main body 10.

When the developing cartridge 70 is pressed downward by the upper pressing members 85 and 87, the developing cartridge 70 is rotated clockwise (i.e., in a direction indicated by arrow B in FIG. 8) around the base projections 73. The upper main body 80 comprises an upper stopper 89 (referring to FIG. 6) to limit the rotation angle of the developing cartridge 70. The upper stopper 89 is installed in a proper position of the upper frame 81 so as to be in contact with the case 71 of the developing cartridge 70 and to limit the clockwise rotation of the developing cartridge 70. Accordingly, the rotation of the developing cartridge 70 is limited by the upper stopper 89 and the lower stopper 19. In the exemplary embodiment, the upper stopper 89 and the lower stopper 19 are installed on the upper main body 80 and the lower main body 10, respectively, so that the developing cartridge 70 can be rotated in a range of about 1 to 3 degrees around the base projections 73.

The developing cartridge 70 forms a toner image that corresponds to the print data on the surface of the photosensitive medium 75, and comprises the case 71, the photosensitive medium 75, a developing roller (not illustrated), a charge roller (not illustrated), and a cleaning member (not illustrated).

Figure 5:
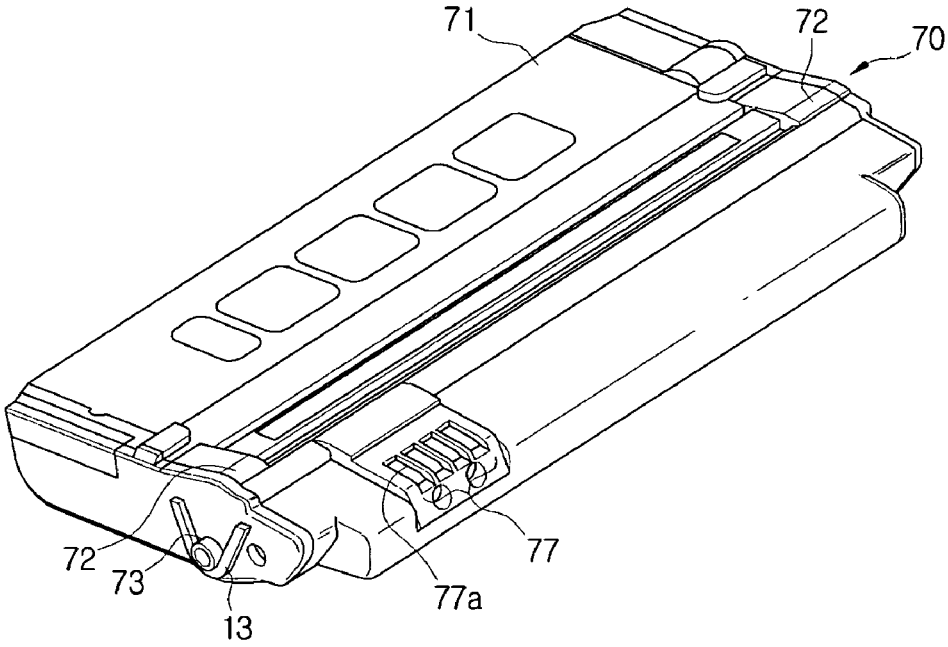
FIG. 5 is a perspective view of a developing cartridge that is mounted on the image forming apparatus of FIG. 1.

The case 71 supports the developing roller and the charge roller so that they can be rotated, and stores therein a predetermined amount of toner. On both side surfaces of the case 71, the base projections 73 outwardly projected are formed. In FIG. 5, only the base projection 73 on one side surface is illustrated, but it should be understood that the same base projection 73 is formed on the opposite side surface of the case 71. The base projection 73 has a cylindrical shape, and is placed in the support groove 13 provided in the lower main body 10. The base projection 73 may be installed so that its center axis coincides with the rotating axis C (referring to FIG. 6) of the photosensitive medium 75. On the upper surface of the case 71, a pressed part that is pressed by the upper pressing member is formed. Accordingly, if plural upper pressing members are provided on the upper main body, plural pressed parts that correspond to the upper pressing members may be formed on the case 71. In the exemplary embodiment, a pressure support part 72 that is pressed by the developing cartridge pressing member 87 is provided on the upper surface of the case 71. The pressure support part 72 is apart from the rotating axis at a predetermined interval, and when the developing cartridge pressing member 87 presses the pressure support part 72, the developing cartridge 70 is rotated around the base projection 73.

The photosensitive medium 75, on which an electrostatic latent image is formed by laser beams irradiated from the exposure unit 90, is in the form of a cylinder, and is rotatably installed in the case 71. A part of the photosensitive medium 75 is exposed from the lower surface of the case 71, and when the developing cartridge 70 is mounted on the lower main body 10 of the image forming apparatus 1, it comes into contact with the transfer roller 40. A photosensitive medium gear 74 that receives power from the driving gear 15 is installed on the same axis as the photosensitive medium 75. When the developing cartridge 70 is placed in the support groove 13 of the lower main body 10, the photosensitive medium gear 74 is meshed with the driving gear 15.

The developing roller is installed on one side of the photosensitive medium 75 inside the case 71, and feeds the toner stored in the case 71 to the photosensitive medium 75. On one side of the developing roller, a toner feeding roller to feed the toner to the developing roller may be installed.

The charge roller charges the surface of the photosensitive medium 75 with a predetermined voltage, and the cleaning member removes the waste toner remaining on the surface of the photosensitive medium 75. The charge roller and the cleaning member may be the same as or similar to those in the prior art.

The developing cartridge 70 comprises a developing cartridge memory, and on the upper surface of the developing cartridge case 71, the terminal part 77 of the developing cartridge memory is installed as illustrated in FIG. 5. In the exemplary embodiment, the terminal part 77 includes of four terminals 77*a*, that is, three signal terminals and one power terminal. Since the terminal part 77 is pressed by the memory connection member 85, it also serves as a pressed part. The developing cartridge memory stores status information of the developing cartridge 70. For example, the developing cartridge memory stores information that indicates the status of the developing cartridge 70, such as the number of printed copies, the residual quantity of toner, the lifespan of the photosensitive medium 75, and so forth. Accordingly, when a user mounts a developing cartridge 70 on the image forming apparatus 1, the control part (not illustrated) of the image forming apparatus 1 judges the status of the developing cartridge 70 mounted on the image forming apparatus 1 by reading data from the developing cartridge memory through the memory connection member 85, and displays the judged status through a display part (not illustrated) such as an LCD to inform the user of the status. The developing cartridge memory, the control part, and the display part of the image forming apparatus 1 may be the same as or similar to those of the conventional image forming apparatus.

Hereinafter, a method of mounting the developing cartridge 70 on the image forming apparatus 1 and moments of force acting on the developing cartridge 70 will be described with reference to FIGS. 6 to 8.

In the case of mounting the developing cartridge 70 on the image forming apparatus 1, the upper main body 80 is lifted up around the hinge shaft 83*a* as illustrated in FIG. 2, and the developing cartridge 70 is inserted into the lower main body 10. In this case, the base projections 73 of the developing cartridge 70 are placed in the support grooves 13 of the lower main body 10.

Figure 7:
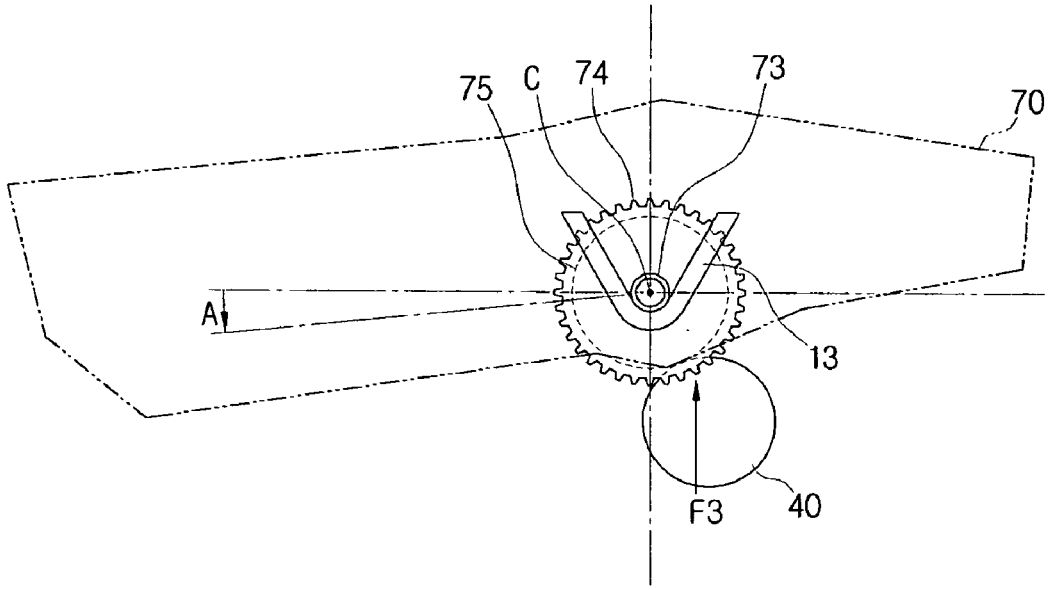
FIG. 7 is a conceptual view explaining moments of force acting on the developing cartridge when an upper main body is opened in an image forming apparatus according to an exemplary embodiment.

FIG. 7 illustrates the force acting on the developing cartridge 70 when the upper main body 80 is opened in a state that the developing cartridge 70 is mounted on the lower main body 10. Referring to FIG. 7, the photosensitive medium 75 of the developing cartridge 70 is in contact with the transfer roller 40. The transfer roller 40 is supported elastically while being biased upward, and thus the developing cartridge 70 is pressed upward by the transfer roller 40. Accordingly, the developing cartridge 70 is supported while being elastically biased upward by the transfer roller 40.

In this state, if the upper main body 80 is closed to cover the upper surface of the lower main body 10, the upper main body 80 is rotated downward around the hinge shaft 83*a*. When the upper main body 80 covers the upper surface of the lower main body 10 (closed position), the upper pressing members 85 and 87 press the developing cartridge 70 downward. That is, the developing cartridge pressing member 87 presses the developing cartridge 70 downward by pressing the upper surfaces of both sides of the developing cartridge case 71, and the memory connection member 85 presses the developing cartridge 70 downward by pressing the terminal part 77 of the developing cartridge memory.

Figure 8:
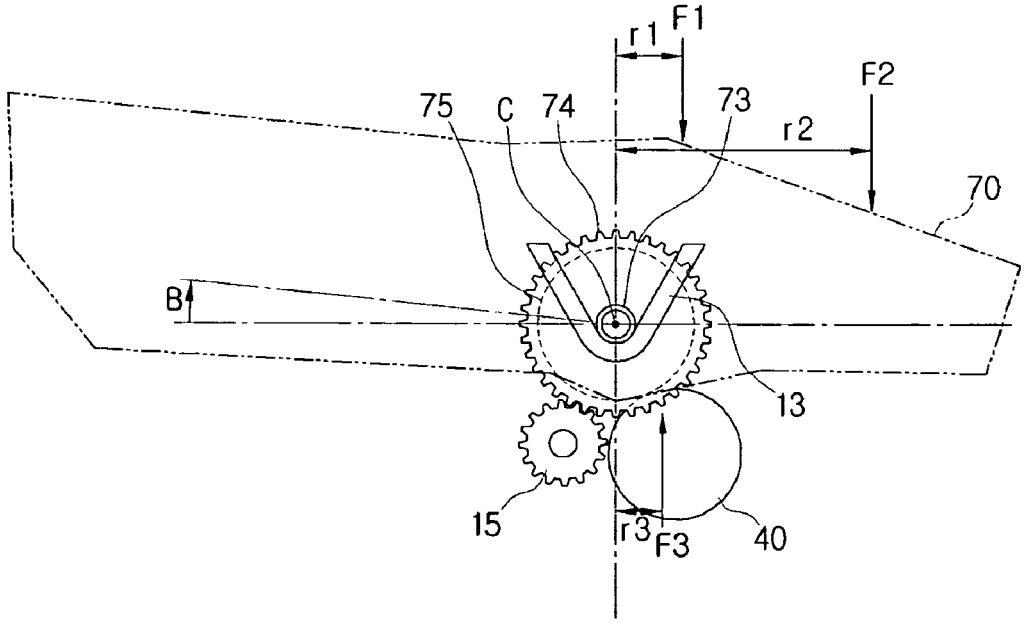
FIG. 8 is a conceptual view explaining moments of force acting on the developing cartridge when a driving gear is not rotated in an image forming apparatus according to an exemplary embodiment.

Referring to FIG. 8, the point of the developing cartridge case 71 pressed by the developing cartridge pressing member 87 is spaced apart by a distance r1 from the center C of the base projection 73 in a direction perpendicular to the direction of force F1, and the point of the terminal part 77 of the developing cartridge memory pressed by the memory connection member 85 is spaced apart by a distance r2 from the center C of the base projection 73 in a direction perpendicular to the direction of force F2. Thus, the developing cartridge 70 is urged to rotate clockwise. That is, the developing cartridge 70 receives moments M1 and M2 of force, which urge the developing cartridge 70 to rotate clockwise around the base projection 73, from the developing cartridge pressing member 87 and the memory connection member 85.

Here, if it is assumed that the force with which the developing cartridge pressing member 87 presses the developing cartridge 70 is F1 and the force with which the memory connection member 85 presses the terminal part 77 of the developing cartridge memory is F2, the moments M1 and M2 can be given by $M1=F1\times r1$, $M2=F2\times r2$.

On the other hand, the developing cartridge 70 is pressed upwards by the vertical (with respect to FIGS. 6-8) component of force F3 being applied from the transfer roller 40. Referring to FIG. 8, since the point of the photosensitive medium 75 pressed by the transfer roller 40 is spaced apart by a distance r3 from the center C of the base projection 73 in a direction perpendicular to the direction of force F3, the developing cartridge 70 is urged to rotate counterclockwise by the transfer roller 40. That is, the developing cartridge 70 receives a moment M3 of force, which urges the developing cartridge 70 to rotate counterclockwise around the base projection 73, from the transfer roller 40. Accordingly, if it is assumed that the vertical component of force being applied from the transfer roller 40 to the photosensitive medium 75 is F3, the moment M3 of force can be given by $M3=F3\times r3$. It is noted that the moment created by the horizontal component of force being applied from the transfer roller 40 to the photosensitive medium 75 may reduce the moment M3. However, it is not discussed here as it is assumed that the component of horizontal force from the transfer roller 40 is counteracted by an equal and opposite force (and thus moment) from driving gear 15 in its idle state (i.e., the force from the driving gear 15 not due to its rotation).

If the sum of the moments M1 and M2 of force produced by the developing cartridge pressing member 87 and the memory connection member 85 is larger than the moment M3 of force produced by the transfer roller 40, the developing cartridge 70 is rotated clockwise as indicated by arrow B in FIG. 8, centering around the base projection 73 when the upper main body 80 is closed with the lower main body 10. In this case, the clockwise rotation of the developing cartridge 70 is limited by the upper stopper 89 installed on the upper main body 80. That is, when the upper main body 80 is closed with the lower main body 10, the developing cartridge 70 mounted on the lower main body 10 is rotated a small amount. If the developing cartridge 70 is rotated a small amount, the toner contained in the developing cartridge 70 is shocked to be shaken, and thus the toner is prevented from being hardened.

When the image forming apparatus 1 is operated after the upper main body 80 is closed, the driving gear 15 is rotated by a motor. If the driving gear 15 is rotated, the photosensitive medium gear 74 that is meshed with the driving gear 15 is urged by the driving gear 15. Referring to FIG. 6, if the driving gear 15 is rotated clockwise, the photosensitive medium gear 74 is urged to rotate counterclockwise. Since the photosensitive medium gear 74 is on the same axis as the center C of the base projection 73 of the developing cartridge 70, the developing cartridge 70 is urged to rotate counterclockwise around the base projection 73 by the driving gear 15. That is, if the driving gear 15 is driven to rotate the photosensitive medium 75, the developing cartridge 70 receives a portion of the moment M4 of force from the driving gear 15, transferred through a frictional rotatable connection of the photosensitive medium 75 to the developing cartridge 70, and is rotated counterclockwise around the base projection 73. In this case, if it is assumed that the distance from the center C of the base projection 73 to the point where the driving gear 15 becomes in contact with the photosensitive medium gear 74 is r4, the moment M4 of force can be given by M4=F4×r4.

In this case, if the driving gear 15 is rotated, the moment M4 of force produced by the driving gear 15 and/or frictional force of the connection of the photosensitive medium 75 to the developing cartridge 70 may be set, so that the developing cartridge 70 can be rotated counterclockwise as indicated by arrow A in FIG. 7, around the base projection 73 by the sum of the moment M3 of force produced by the transfer roller 40 and the portion of the moment M4 of force produced by the driving gear 15. If the driving gear 15 is rotated, the developing cartridge 70 may be rotated in a direction (as indicated by arrow B in FIG. 8) opposite to the direction in which the developing cartridge 70 had been rotated when the upper main body 80 is closed.

The counterclockwise rotation of the developing cartridge 70 is limited by the lower stopper 19 installed on the lower main body 10. Accordingly, even in the case where the moment M4 of force produced by the driving gear 15 transferred to the developing cartridge 70 is very large, the counterclockwise rotation of the developing cartridge 70 is limited by the lower stopper 19. That is, the developing cartridge 70 mounted on the lower body 10 is rotated a small amount when the photosensitive medium 75 is rotated by the driving gear 15. If the developing cartridge 70 is rotated a small amount as described above, the toner contained in the developing cartridge 70 is shaken, and this prevents the toner stored in the developing cartridge 70 from being hardened.

The moment M4 of force produced by the driving gear 15 may be properly determined so that all of the forces acting on the developing cartridge 70 when the driving gear 15 is rotated are kept in equilibrium. When the moments of force are kept in equilibrium, the position of the developing cartridge 70 is kept stably, and this causes the position of the photosensitive medium 75 of the developing cartridge 70 with respect to the transfer roller 40 also to be kept stably. Accordingly, the toner image of the photosensitive medium 75 of the developing cartridge 70 may be stably transferred to the print medium passing between the photosensitive medium 75 and the transfer roller 40.

Preferably however, the portion of the moment M4 of force transferred to the developing cartridge 70 produced by the driving gear 15 is large so that the rotation of the developing cartridge 70 is limited by the lower stopper 19, and thus the position of the developing cartridge 70 is kept stably. In this case, the portion of the moment M4 of force transferred to the developing cartridge 70 need only be large enough to overcome opposing moments to the developing cartridge 70. Accordingly, the toner image of the photosensitive medium may be stably transferred to the print medium.

Hereinafter, a method of separating the developing cartridge 70 mounted on the image forming apparatus and moments of force acting on the developing cartridge 70 when the developing cartridge 70 is separated from the image forming apparatus will be described with reference to FIGS. 7 and 8.

If the motor is stopped during the operation of the image forming apparatus 1, the driving gear 15 is stopped. In this case, as illustrated in FIG. 8, the moment M4 of force produced by the driving gear 15 does not act on the developing cartridge 70, but only the moments M1 and M2 of force produced by the developing cartridge pressing member 87 and the memory connection member 85 and the moment M3 of force produced by the transfer roller 40 act on the developing cartridge 70. In this case, since the moments M1 and M2 of force produced by the developing cartridge pressing member 87 and the memory connection member 85 are larger than the moment M3 of force produced by the transfer roller 40, the developing cartridge 70 is rotated clockwise as indicated by arrow B, around the base projection 73. At this time, the clockwise rotation of the developing cartridge 70 is limited by the upper stopper 89 of the upper main body 80. Accordingly, the developing cartridge 70 is rotated a small amount clockwise around the base projection 73. If the developing cartridge 70 is rotated, the toner stored in the developing cartridge 70 is shaken due to a shock, and thus the toner is fed smoothly.

In this state, if the upper main body 80 that covers the upper surface of the lower main body 10 is rotated upward as illustrated in FIG. 1, the upper main body 80 is opened against the lower main body 10 as illustrated in FIG. 2. In this case, only the moment M3 of force produced by the transfer roller 40 acts on the developing cartridge 70 as illustrated in FIG. 7. Accordingly, the developing cartridge 70 is rotated counterclockwise as indicated by arrow A around the base projection 73, by the moment M3 of force acting on the transfer roller 40. That is, the developing cartridge 70 is rotated in a direction opposite to the direction (as indicated by arrow B in FIG. 8) in which the developing cartridge 70 had been rotated when the driving gear 15 is stopped.

In this state, if a user takes the developing cartridge 70 out of the lower main body 10, the separation of the developing cartridge 70 is completed. In this case, since the developing cartridge 70 is urged upward by the transfer roller 40, the user can easily separate the developing cartridge 70 from the lower main body 10.

The operation of the image forming apparatus having the above structure according to an exemplary embodiment will be described with reference to FIG. 1.

If a print command and print data are received, the image forming apparatus 1 operates the exposure unit 90 to emit laser beams corresponding to the print data. The laser beams emitted from the exposure unit 90 pass through the exposure hole 82 (referring to FIG. 3) formed on the upper main body 80, and are incident to the photosensitive medium 75 of the developing cartridge 70 installed on the lower main body 10, so that an electrostatic latent image that corresponds to the print data is formed on the surface of the photosensitive medium 75. The electrostatic latent image formed on the photosensitive medium 75 is developed as a toner image by the toner fed by the developing roller. At this time, the photosensitive medium 75 is driven by driving gear 15 to rotate. Frictional forces connecting the photosensitive medium 75 to the developing cartridge 70 act to rotate the developing cartridge in a counterclockwise direction (with respect to FIGS. 6-8) until the developing cartridge is pressed against the lower stopper 19.

If the print command is received, the image forming apparatus 1 operates the print medium feed unit 20 to pick up and convey the print medium to the conveyor roller unit 30 sheet by sheet. The print medium detection sensor 21 detects whether the print medium P is loaded in the print medium feed unit 20.

The print medium P picked up by the print medium feed unit 20 passes through two pairs of conveyor rollers 31 and 32, and then is conveyed between the photosensitive medium 75 and the transfer roller 40. The feed sensor 41 detects the print medium that is conveyed between the photosensitive medium 75 and the transfer roller 40.

When the print medium is conveyed between the photosensitive medium 75 and the transfer roller 40, the toner image formed on the photosensitive medium 75 is transferred to the print medium. At this time, the position of the developing cartridge 70 is stably kept by the upper pressing members, here including the memory connection member 85 and the developing cartridge pressing member 87, and the lower pressing members, here including the driving gear 15 and the transfer roller 40, and thus the position of the photosensitive medium 75 with respect to the transfer roller 40 is also kept stably. Accordingly, the toner image formed on the photosensitive medium 75 of the developing cartridge 70 is stably transferred to the print medium.

The print medium to which the toner image has been transferred is moved to the fuser unit 50. While the print medium passes between the pressing roller 52 and the heating roller 51 of the fuser unit 50, the toner image is fused on the print medium.

The print medium of which the fusing has been completed is delivered by the delivery unit 60 to an outside of the image forming apparatus 1. At this time, the delivery sensor 61 detects the delivered print medium.

According to the embodiments of an image forming apparatus and a method of mounting/separating a developing cartridge on/from the image forming apparatus described above, if the developing cartridge is mounted on the image forming apparatus, a photosensitive medium of the developing cartridge may stably keep its position with respect to a transfer roller. Accordingly, a toner image on the photosensitive medium can be stably transferred to a printing medium.

Additionally, in the embodiments of an image forming apparatus and a method of mounting/separating a developing cartridge on/from the image forming apparatus described above, the developing cartridge is rotated a small amount when the developing cartridge is mounted or a photosensitive medium is driven, and thus toner stored in the developing cartridge is shocked to be shaken. Accordingly, the toner is prevented from being hardened, and the toner is smoothly fed by a developing roller.

Furthermore, if an upper main body is opened to separate the developing cartridge from the image forming apparatus, the force that is produced by upper pressing members to press the developing cartridge is removed, and only the force produced by lower pressing members acts on the developing cartridge, so that the developing cartridge can be easily separated from the image forming apparatus.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

As used in this disclosure, the term "preferably" is non-exclusive and means "preferably, but not limited to." Terms in the claims should be given their broadest interpretation consistent with the general inventive concept as set forth in this description. For example, the terms "coupled" and "connect" (and derivations thereof) are used to connote both direct and indirect connections/couplings. As another example, "having" and "including", derivatives thereof and similar transition terms or phrases are used synonymously with "comprising" (i.e., all are considered "open ended" terms)—only the phrases "consisting of" and "consisting essentially of" should be considered as "close ended". Claims are not intended to be interpreted under 112 sixth paragraph unless the phrase "means for" and an associated function appear in a claim and the claim fails to recite sufficient structure to perform such function.

What is claimed is:

1. An image forming apparatus comprising:

a lower main body of the image forming apparatus;

a developing cartridge installed in the lower main body, and comprising a photosensitive medium;

an upper main body of the image forming apparatus installed on an upper side of the lower main body, and comprising an upper pressing member to press the developing cartridge downward; and a lower pressing member, installed in the lower main body, to press the developing cartridge upward;

wherein a moment of force being applied' to the developing cartridge by the upper pressing member about a rotation axis of the photosensitive medium and a moment of force being applied to the developing cartridge by the lower pressing member about a rotation axis of the photosensitive medium act in opposite directions to each other, wherein the developing cartridge is rotatably installed with respect to the lower main body and wherein when the photosensitive medium starts its rotation, the developing cartridge is rotated with respect to the lower main body, thereby shaking the toner and preventing the toner from becoming hardened.

2. The image forming apparatus of claim 1, wherein the developing cartridge comprises base projections installed on both side surfaces thereof;

the lower main body comprises support grooves to support the base projections; and the developing cartridge is rotated around the base projections by the moment of force produced by the lower pressing member or the upper pressing member.

3. The image forming apparatus of claim 2, wherein the lower main body further comprises a stopper to limit rotation of the developing cartridge.

4. The image forming apparatus of claim 1, wherein the upper pressing member comprises at least one of a developing cartridge pressing member and a memory connection member.

5. The image forming apparatus of claim 1, wherein the lower pressing member comprises at least one of a transfer roller and a driving gear.

6. The image forming apparatus of claim 1, wherein when the photosensitive medium is rotated, the moments of force being applied to the developing cartridge by the upper pressing member and the lower pressing member are kept in equilibrium.

7. The image forming apparatus of claim 1, wherein when the upper main body is opened, the developing cartridge is rotated in the same direction as that when the photosensitive medium is rotated.

8. The image forming apparatus of claim 7, wherein when the upper main body is closed with the lower main body, the developing cartridge is rotated in a direction opposite to a direction of the developing cartridge is rotated when the upper main body is opened.

9. A method of separating a developing cartridge from an image forming apparatus, comprising:

when a driving gear that rotates a photosensitive medium of the developing cartridge installed in a lower main body portion of the image forming apparatus is stopped, rotating the developing cartridge in a first direction with respect to the lower main body portion;

when an upper main body portion of the image forming apparatus is opened, rotating the developing cartridge in a direction opposite to the first direction with respect to the lower main body portion; and removing the developing cartridge from the lower main body portion, wherein the developing cartridge rotates in the first direction with respect to the lower main body portion, thereby shaking toner in the developing cartridge and preventing the toner from becoming hardened.

10. The method of claim 9, wherein the developing cartridge is rotated around base projections formed on both side surfaces thereof.

11. The method of claim 9, wherein when the upper main body is opened, the developing cartridge is rotated by a transfer roller installed in the lower main body portion.

12. The method of claim 9, wherein when the driving gear is stopped, the developing cartridge is rotated by an upper pressing member installed in the upper main body portion.

13. A developing cartridge mounted on an image forming apparatus, comprising:

a case having two pressure support parts and a terminal part formed on an upper surface of the case;

a photosensitive medium rotatably installed in the case and having a part exposed from a surface of the case; and a photosensitive medium gear rotatable about a rotation axis of the photosensitive medium;

wherein when the developing cartridge is installed on the image forming apparatus, force acting on upper sides of the two pressure support parts and the terminal part urges the case to be rotated in a first direction around the rotation axis of the photosensitive medium, and force being applied to a surface of the photosensitive medium by a transfer roller of the image forming apparatus urges the case to be rotated in a direction opposite to the first direction, wherein when the photosensitive medium gear rotates the photosensitive medium, the case is rotated in the direction opposite to the first direction, thereby shaking toner in the developing cartridge and preventing the toner from becoming hardened.

14. The developing cartridge of claim 13, wherein when the force acting on the two pressure support parts and the terminal part is removed, the case is rotated in the direction opposite to the first direction.

15. A photosensitive medium for a developing cartridge that is separably installed in an image forming apparatus, wherein the developing cartridge comprises a case having pressure support parts formed on an upper surface of the case and pressed by a developing cartridge pressing member installed in the image forming apparatus when the developing cartridge is installed in the image forming apparatus, and a terminal part providing communication with a developing cartridge memory formed on the upper surface of the case and being in contact with a memory connection member installed in the image forming apparatus, and projections formed on both side surfaces of the case, wherein the photosensitive medium comprises:

a photosensitive medium gear rotatably installed in the case to rotate about an axis of rotation of the photosensitive medium, and positioned to mesh with a driving gear of the image forming apparatus;

wherein when the developing cartridge is installed on the image forming apparatus and the driving gear of the image forming apparatus starts its rotation, a resultant moment of force about the axis of rotation resulting from forces applied to the pressure support parts and the terminal part of the developing cartridge memory and a moment of force about the axis of rotation resulting from a force applied to the photosensitive medium gear are in opposite directions to each other, wherein when the photosensitive medium gear rotates the photosensitive medium, the case is rotated in a direction, thereby shaking toner in the developing cartridge and preventing the toner from becoming hardened.

16. A method of forming an image, comprising:

moving a cartridge mounted within a housing of an image forming apparatus from a first position to a second position;

transferring an image from a photosensitive medium within the cartridge to a printing medium external to the cartridge while the cartridge is in the second position, wherein the cartridge is moved from the first position to the second position, thereby shaking toner in the cartridge and preventing the toner from becoming hardened;

moving the cartridge from the second position to the first position after the transferring operation; and moving the photosensitive medium with a driving mechanism, wherein the operation of moving the cartridge from the second position to the first position includes applying a force from an elastic member to bias the cartridge towards the first, position, and wherein the operation of moving the cartridge from the first position to the second position includes applying a force from the driving mechanism to the cartridge to overcome the force applied by the elastic member.

17. The method of claim 16, wherein the operation of moving the cartridge from the first position to the second position includes moving the cartridge to abut up against at least a first stopper connected to the housing.

18. The method of claim 16, wherein the operation of moving the cartridge from the second position to the first position includes transferring a force from a moveable upper portion of the housing to the cartridge through the elastic member to bias the cartridge towards the first position.

19. The method of claim 16, wherein the moving operations comprise rotating the cartridge.

20. The method of claim 16, wherein the moving operations comprise rotating the cartridge.

* * * * *